United States Patent [19]

Daintrey

[11] 4,348,979

[45] Sep. 14, 1982

[54] DEVELOPER UNIT FOR DRY TONER ELECTROPHOTOGRAPHIC COPIER

[75] Inventor: Joseph W. Daintrey, Walthamstow, England

[73] Assignee: Gestetner Manufacturing Limited, London, England

[21] Appl. No.: 258,029

[22] Filed: Apr. 27, 1981

[30] Foreign Application Priority Data

May 2, 1980 [GB] United Kingdom ..... 8014768

[51] Int. Cl.[3] ..... G03G 15/00

[52] U.S. Cl. ..... 118/688; 118/657; 118/658; 355/3 DD

[58] Field of Search ..... 118/688, 657, 658; 355/3 DD

[56] References Cited

FOREIGN PATENT DOCUMENTS

| | | |
|---|---|---|
| 136 | 6/1978 | European Pat. Off. . |
| 2368068 | 5/1978 | France . |
| 2407501 | 5/1979 | France . |
| 1367681 | 9/1974 | United Kingdom . |

*Primary Examiner*—Bernard D. Pianalto

*Attorney, Agent, or Firm*—Fleit & Jacobson

[57] ABSTRACT

A magnetic brush monocomponent developer unit includes a doctor blade for rendering uniform the layer of toner magnetically attracted to the surface of a shell within which a rotating magnetic roller is positioned. A coil connected to the doctor blade receives an alternating magnetic field in response to rotation of the roller and the induced voltage fluctuations in that coil are sensed to determine when the voltage amplitude exceeds a given threshold value (indicative of a low amount of toner held back by the doctor blade) at which application of toner to the layer by way of a metering roller and sealing brushes is resumed.

7 Claims, 3 Drawing Figures

DEVELOPER UNIT FOR DRY TONER ELECTROPHOTOGRAPHIC COPIER

DESCRIPTION

A well known type of electrophotographic copier has a photosensitive drum, the surface of which, in use, is uniformly electrostatically charged before being imaged by exposure to an illuminated orginal so that the charge is retained on merely the areas of the drum corresponding to the block areas of the original. The surface with this latent electrostatic image is then passed to a developer unit which applies toner. The toner becomes held to the charged areas and can then be transferred to copy paper to which it can be fixed, usually by heat or pressure to form a permanent copy. Alternatively the photosensitive surface may comprise a photoconductor layer on a sensitised copy sheet, and the latent image will then be formed on the copy sheet and developed by application of toner thereto, before fixing.

This invention relates to developer units which apply the toner to the latent electrostatic images. More particularly it is concerned with developer units which use monocomponent toner, that is to say units in which there are no, or substantially no, carrier particles.

In a magnetic brush type of developer unit, a cylindrical shell of non-magnetic material lies parallel to the path of the photoconductor surface with the surfaces of the shell and photoconductor being separated by a small gap. A magnetic roller is rotatably mounted within the shell, and a stationary doctor blade lying parallel to and spaced from the shell surface limits and makes uniform the thickness of the toner layer moving around the shell. The monocomponent toner is magnetically attractable and, in use is held against and moved over the shell surface by rotation of the magnetic roller and/or the shell by at least one external motor. The charge image on the photoconductor can attract toner particles across the small gap present between itself and the magnetically attracted toner layer on the shell.

Copies supplied by the machine are required to be of uniform density over their area, whether they be the first or the last copies of a long series, and the uniform and constant density is required whether the image occupies almost none or almost all of the copy area. The rate of removal of toner from the shell is therefore variable over a large range, determined solely by the appearance of the originals offered for copying.

Earlier attempts to monitor and replenish monocomponent toner have relied on a rotating agitator which has acted to propel the toner from a reservoir to a development roller, against the pressure of a lightly spring-biased, pivoted member, which has closed a microswitch upon failure of the toner supply. Closing the switch either actuates an indicator lamp or bell, or opens an inlet to admit further toner. Such monitoring devices cause agglomeration of the toner because (a) there is a bulk toner beneath the development roller, which becomes compressed by rotation of the roller, and because (b) the toner is being bodily compressed to propel it past the pivoted member.

The problem of agglomeration occurs further in plain paper copies using magnetic brush developer units which have the developer roller lying in a bed of toner because, due to the nearness of the developer unit to the photoconductor drum, when it is required to remove the developer unit from the machine for servicing, provision has to be made for moving the developer roller radially away from the photoconductor surface of the drum prior to withdrawing it in the direction of its axis. That radial movement compresses toner seriously.

The problem of agglomeration of toner is of paramount importance when using any of the pressure-fixing type of monocomponent toners which are becoming more popular.

Accordingly the present invention provides a magnetic brush monocomponent developer unit comprising a magnetic roller having several magnetic poles distributed around its axis; a cylindrical support for a rotating layer of toner concentric with said roller; a doctor blade positioned adjacent the cylindrical support for rendering the rotating layer uniform; and toner-responsive means comprising (a) at least one coil mounted on the doctor blade on that side which the rotating layer of toner approaches in use of the developer unit, so as to be intersected by the moving magnetic field of the said poles of the magnetic roller when the roller is rotating in use of the developer unit, and positioned such that the strength of the field induced in the coil will depend upon the amount of toner held back by the doctor blade, and (b) means responsive to the field intersecting said coil for controlling supply of toner to said cylindrical support.

A developer unit embodying this invention is described below with reference to the accompanying drawings, in which:

DETAILED DESCRIPTION OF THE DRAWING

Figure 1:
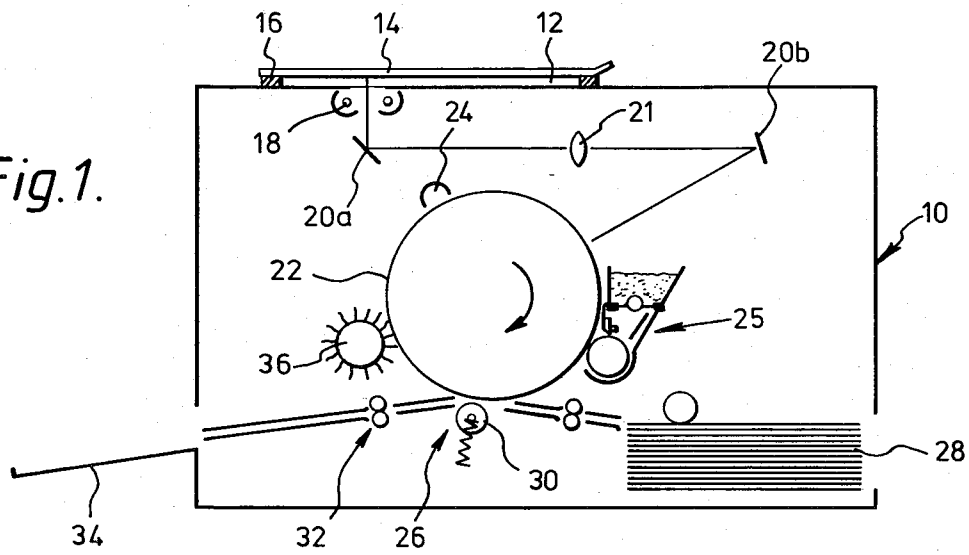
FIG. 1 is a diagrammatic view of a typical copier, incorporating a developer unit in accordance with the present invention.

The "plain paper" type of copier shown in FIG. 1 comprises a housing 10 having on its upper surface a transparent window 12 on which an original is placed for copying. A hinged platen cover 14 lies over the original. The window and the cover are attached to a frame 16 which can be reciprocated by a motor not shown, to move the original past an imaging station within the housing. That station comprises lamp 18, mirrors 20*a* 20*b*, and a lens 21. Their effect is to project an image of the original onto a photosensitive drum 22 as the latter rotates. Before receiving the image the drum surface has received an electrostatic charge from a corona 24. The imaging causes the charge to be retained only on the areas of the drum which have not been illuminated, i.e. the black regions of the original. This is referred to as the charge image. The charge image then passes to a developer unit 25 which applies monocomponent toner (i.e. toner powder) to the drum to be held to the charge image but not the now discharged background. The developed image passes to a transfer station 26, at which it meets a sheet of paper moved from a stack 28. Electrical bias on a roller 30, which lightly presses the paper against the drum 22, transfers the toner image to the paper. The imaged paper passes then between rollers 32 which (a) pressure fuse the image to fix it to the paper and (b) deliver the sheet to a delivery tray 34. The drum 22 in the meantime moves past a brush 36 which cleans residual toner from the surface, whereupon the drum moves to the charging station 24 to begin the next copy cycle. It is clear to anyone skilled in the art that this is a very brief outline of one process and many alternatives and modifications are well known.

Figure 2:
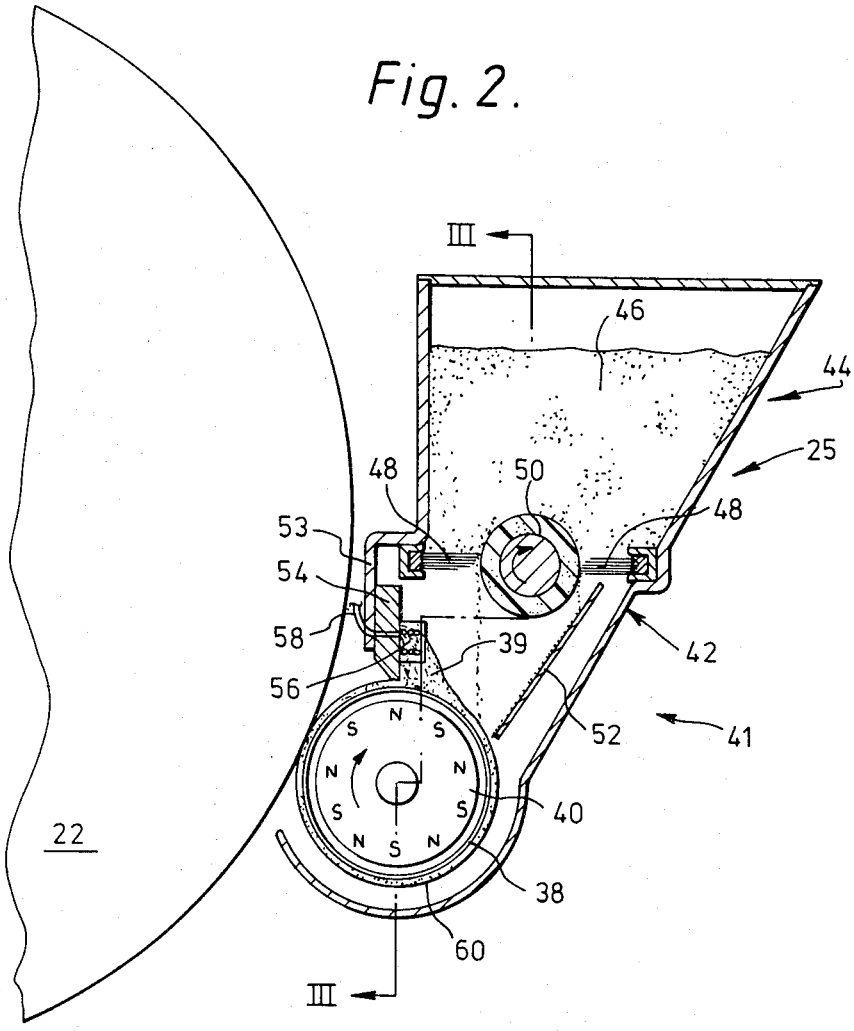
FIG. 2 is an end sectional view of the developer unit of FIG. 1 to a larger scale.
Figure 3:
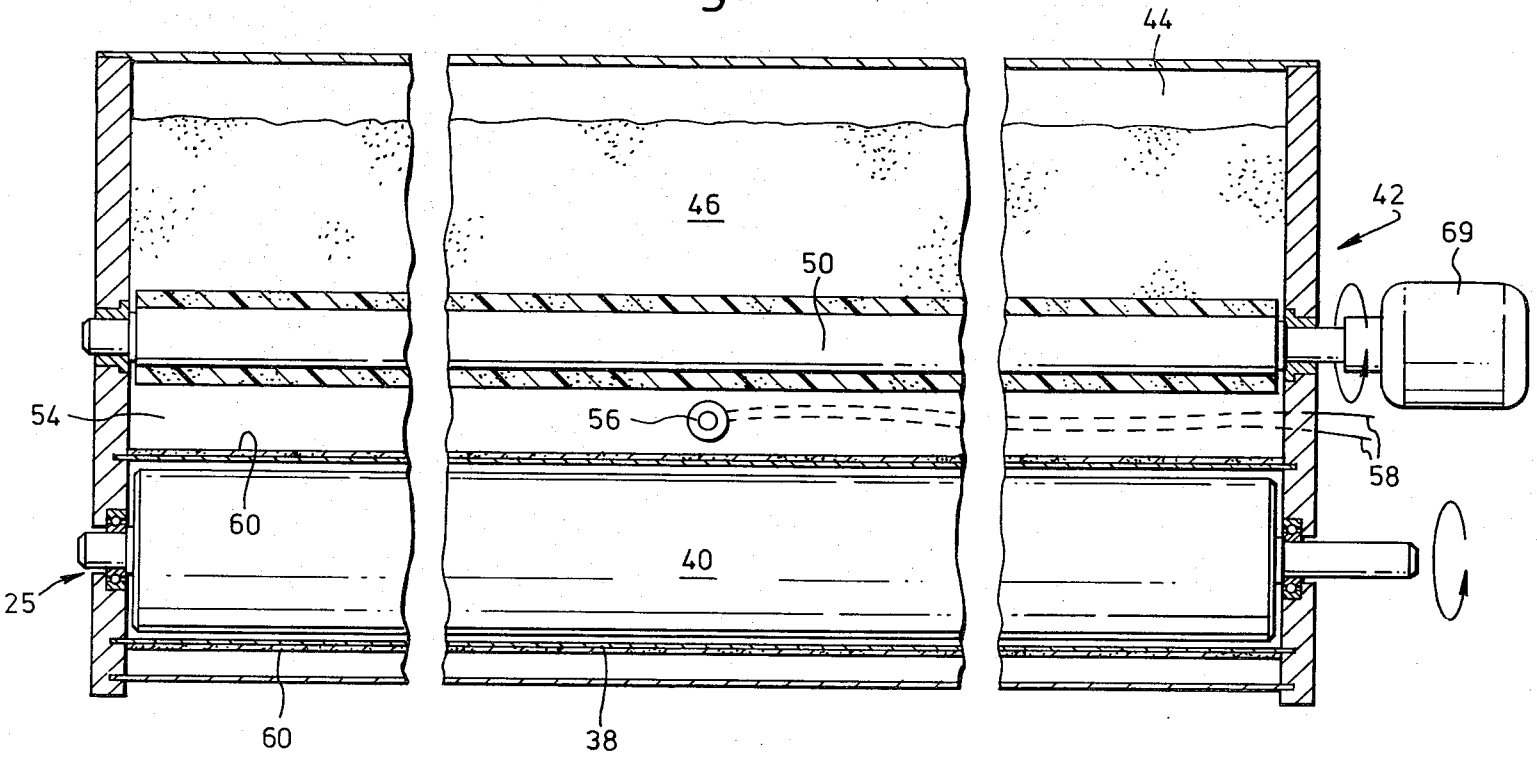
FIG. 3 is a section taken as indicated by the line III—III of FIG. 2.

The present invention is concerned with the developer unit 25 which is shown in greater detail in FIGS. 2 and 3.

The developer unit 25 comprises a stationary cylindrical shell 38, the axis of which is parallel to that of the photosensitive drum 22. Within the shell 38 is a magnetic roller 40 which is constituted by ten alternately polarised, angularly arranged north and south magnetic poles, acting radially. The magnetic roller 40 is rotatable by an external motor, not shown, and has its shaft ends passing through end walls of the lower part 41 of a hopper 42, the upper part of which constitutes a reservoir 44 for toner 46.

Two long brushes 48 mounted in grooves in the wall of the hopper 42 extend inwardly for their free ends to engage a toner-metering roller 50 and effectively seal the reservoir 44 from the hopper lower part 41. The toner-metering roller 50 has a metal core and a foam rubber outer sleeve, and is rotatable by a motor 69 described below. Beneath the toner-metering roller 50 is a deflector plate 52 to guide toner falling from the right-hand (or rearwardly disposed) brush 48 towards the surface of the shell 38.

Adjustably fastened to the lower edge of the hopper wall 53 adjacent to the drum 22 is a doctor blade 54, the lower edge of which is parallel to but spaced slightly from the outer surface of the shell 38. Mounted on the blade 54 is a coil 56, the axis of which extends across FIG. 1 as drawn. The coil winding connects to leads 58 which pass to an electric circuit shown diagrammatically in FIG. 4.

In use of the developer unit, bulk toner powder is poured into the reservoir 44 by a machine operator. Rotation of the toner-metering roller 50, actuated by the electric circuit to be described below with reference to FIG. 4, in the clockwise direction as viewed in FIG. 2 causes toner on the roller surface to pass the one brush 48, whereupon some of it is released from the surface, the rest being ejected by the second brush. The toner falls onto the deflector plate 52 which leads it to the shell 38.

The toner is magnetic and it is known that clockwise rotation of the magnets 40 causes the toner to move anticlockwise round the surface of the shell 38 while being held to it. The gap between the doctor blade 54 and the shell 38 causes the toner to spread over the shell to form a uniform toner layer 60 covering the shell 38. Toner continues to fall from the roller 50 until there is a build-up 39 of toner along the blade 54 at the position shown in FIG. 2, that is to say on the side of the doctor blade 54 towards which the toner moves as it approaches the blade. As the build-up 39 accumulates, the coil 56 positioned on the blade 54 then becomes substantially submerged in that toner build-up.

The alternately oriented magnetic fields from the magnetic roller 40 pass through the coil 56, so that rotation of the magnetic roller 40 will cause an alternating voltage to be induced in the coil. The strength of the field intersecting the coil, and hence of the induced voltage in the coil with a constant rate of rotation of the magnetic roller 40 is weakened by the magnetic reluctance of the toner-enveloping the coil at 39. The circuit to be described below with reference to FIG. 4 acts to interrupt the rotation of the toner-metering roller 50 when the toner at 39 substantially covers the coil 56, and acts to restart it rotating when the coil 56 is substantially uncovered. In this way the uniform toner layer 60 is maintained on the shell 38 and only a small amount of toner in excess of that layer 60 will remain in the build-up 39 covering the coil. This build-up 39 is of course substantially uniform along the length of the blade 54.

During a copying operation the charge image moving past the small gap between the drum 22 and the toner layer 60 attracts toner from the layer 60. The depleted layer 60 is replenished from the build-up 39, until the coil 56 is uncovered to such an extent that the fluctuations induced in the coil 56 are increased in amplitude to the threshold value at which the circuit of FIG. 4 responds by causing the motor 69 to resume drive to the toner-metering roller 50. The toner-replenishing cycle described above proceeds until the toner build-up 39 at the coil again causes the induced fluctuations to decrease in amplitude. The circuit senses the decrease and stops the motor.

Figure 4:
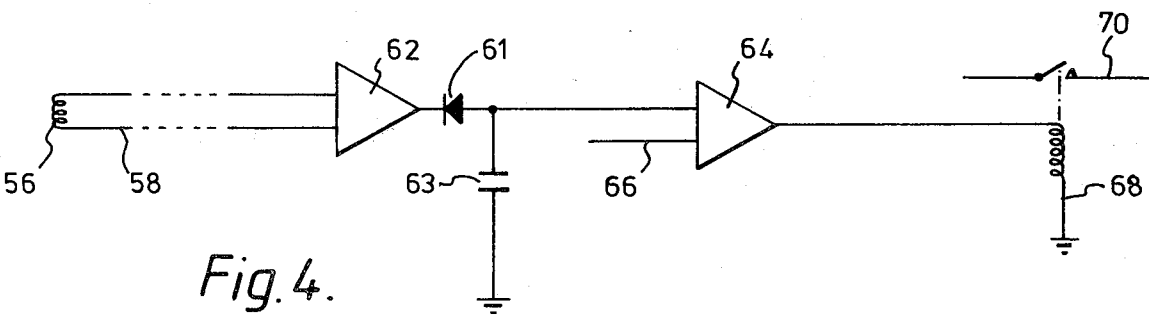
FIG. 4 is a block diagram of the electrical circuit.

FIG. 4 shows schematically the coil 56 and its leads 58. Their output passes through an amplifier 62, those output passes to a comparator 64 after rectification and smoothing by means of diode 61 and capacitor 63.

In the comparator 64 the amplifier output is compared to a reference input voltage or input 66. That reference voltage is arranged to be exceeded by the increased amplitude consequent on a substantial absence of toner at the coil 56, but to be greater than the amplifier output amplitude when the coil 56 is substantially covered. The comparator 64 only gives an output when the standard voltage is exceeded. That output actuates a solenoid 68 which closes a switch 70 to energise the motor 69 driving the toner-metering roller 50.

The parameter actuating the control is the quantity of toner at the coil. That is directly and solely dependent on the depletion of toner from the shell 38, and this is determined purely by the image density of the copy. Localised depletions, for example due to a dense black image on one side of the original and mostly white background on the other side, may be compensated for by migration of toner along the blade 54 to redistribute the toner build-up 39 in an even manner along the blade.

The bulk of the monocomponent toner is held static and uncompressed in the reservoir 44 and is effectively filtered and dispersed by the action of the toner-metering roller 50 and the brushes 48. It then simply falls freely under gravity to the magnetic cylinder, obviously avoiding agglomeration.

The shell 38 does not reside in a bed of toner, and can therefore easily be moved radially from the drum 22 to permit its axial withdrawal for servicing, without compressing the toner layer by that radial movement.

Apart from the free surface of the toner in the reservoir, which in any case has a lid, the only toner exposed to the environment is that which is held to the shell 38, by the magnets of roller 40, at the development zone where the shell 38 is exposed to the exterior of the housing 42. Because of the doctoring action of the blade 54, that amount is less than the magnets are capable of supporting. The toner is therefore not free to disperse into the machine.

Obviously the amount of toner at the coil 56 which is sufficient to actuate then de-actuate the control circuit is a matter to be decided after experiments. Different toners will have different magnetic reluctances, and the amount of hysteresis necessary for satisfactory operation can be determined by details of the control circuit. Suitable compensation means, for example a means of adjusting the reference voltage on input 66 to the comparator 64 of FIG. 4, may be provided in order to enable the developer unit 41 to be adjusted to suit different toners.

Within the scope of this invention there can be two or even more coils positioned along the doctor blade. Those coils can either be connected to one another so that their output is an averaging summation, or each coil can control a respective toner-admitting device from the reservoir. This would be useful for instance if it is envisaged that toner will be used mainly from one portion of the shell.

As alternative toner-metering means, in place of the motor driven toner-metering roller 50 and the brushes 48, there could be a solenoid which, upon actuation could withdraw a shutter which covers a slot or slots in the bottom of the reservoir. An agitator in the reservoir could be simultaneously actuated to assist free fall of the toner.

It is important, however, that this toner-metering means supplying toner from the reservoir 44 is quite separate from the build-up 39 of toner detected by the coil. If the toner-metering means were to supply toner directly to the build-up 39, disadvantageous interactions between the toner-metering action and the toner-doctoring action could arise, and could cause undesirable non-uniformity of the toner layer on the magnetic brush roller shell 38.

The use of a passive coil 56 energised by the fluctuating field induced by the necessary magnets of roller 40 (the field intersecting the coil being modulated by the toner build-up 39), rather than a coil system requiring a separate excitation field to be generated (for example by a separate excitation coil), is also an important advantage of this invention, giving rise to economy of construction and operation.

I claim:

1. A magnetic brush monocomponent developer unit comprising:

(a) magnetic roller means having an axis and several magnetic poles distributed around its said axis;

(b) cylindrical support means for a rotating layer of toner concentric with said roller;

(c) means applying toner to said cylindrical support means;

(d) doctor blade means positioned adjacent the cylindrical support means, for rendering the rotating layer uniform; said doctor blade means having first and second sides arranged so that in use of the developer unit a rotating layerof toner on said cylindrical support moves towards said first side; and (e) toner-responsive means comprising (i) coil means mounted on said doctor blade means on said first side thereof so as to be intersected by the moving magnetic field of the said poles of the magnetic roller means when said magnetic roller means is rotating in use of the developer unit, said coil means being positioned such that the strength of the magnetic field induced in the coil means by the fields of the magnetic poles of the magnetic roller means will depend upon the amount of toner held back by the doctor blade means, and (ii) means responsive to the field intersecting said coil means, for controlling supply of toner to said cylindrical support means.

2. A monocomponent developer unit according to claim 1, wherein said means responsive to the field intersecting said coil means comprises a circuit for processing the voltage induced in the coil, said processing circuit including means for supplying a reference voltage; means for amplifying said induced voltage and comparator means for comparing said amplified induced voltage with said reference voltage, said reference voltage being chosen to be of a value which is exceeded only when the quantity of toner held back by the doctor blade means is less than a threshold value of toner quantity below which the further application of toner to said cylindrical support means by said toner applying means is to be actuated.

3. A monocomponent developer unit according to claim 2, and including toner-metering means connected to said toner-responsive means and means effective to operatively interconnect said voltage comparing means and said toner-metering means to suspend operation of said toner metering means from the instant of receiving a signal indicative of the output voltage of said amplifying means having fallen below said threshold value, and to resume the application of toner only upon receipt of a signal indicative of said output voltage of the amplifying means exceeding said threshold value.

4. A monocomponent developer unit according to claim 3, wherein said toner-metering means is activated when the output voltage of said amplifying means exceeds said reference voltage, and said toner-metering means is maintained in operation until said reference voltage always exceeds the said output voltage of the amplifying means during the cyclic variation of the said voltage induced in the coil means.

5. A monocomponent developer unit according to claim 3, wherein said toner-metering means comprises metering roller means having a horizontal axis of rotation parallel to the axis of symmetry of said cylindrical support means and spaced thereabove, and brush means engaging said metering roller means at horizontally spaced locations on the cylindrical surface thereof for holding a supply of toner above the level of the brush means until such time as rotation of the said metering roller means is initiated in response to reduction of the amount of toner affecting the induced voltage in said coil means.

6. A monocomponent developer unit according to claim 5, wherein said brushes extend diametrically of the metering roller and a deflector plate is mounted below the level of said brushes for ensuring that the toner passing between the brushes and the surface of said metering roller all reaches the toner layer on said cylindrical support.

7. A monocomponent developer unit according to claim 5, including motor means drivably connected to said metering roller means, and means operative to switch on said motor means in response to the output of said comparator means, said switching means including a solenoid effective to energise said motor means in response to the comparison between the amplified induced voltage in said coil and said reference voltage defining the threshold at which the application of toner resumes or is suspended.

* * * * *